US006715753B1

(12) United States Patent
Conca et al.

(10) Patent No.: US 6,715,753 B1
(45) Date of Patent: Apr. 6, 2004

(54) METHOD FOR PUTTING INTO STORAGE AND DISPENSING SHEET-LIKE OBJECTS, AND DEVICE FOR CARRYING OUT THIS METHOD

(75) Inventors: Olivier Conca, Olten (CH); Olivier Gaeumann, Neuchatel (CH)

(73) Assignee: De La Rue International, Ltd. (GB)

( * ) Notice: Subject to any disclaimer, the term of this patent is extended or adjusted under 35 U.S.C. 154(b) by 0 days.

(21) Appl. No.: 10/129,015

(22) PCT Filed: Nov. 15, 2000

(86) PCT No.: PCT/CH00/00610

§ 371 (c)(1),
(2), (4) Date: Jun. 17, 2002

(87) PCT Pub. No.: WO01/36309

PCT Pub. Date: May 25, 2001

(30) Foreign Application Priority Data

Nov. 18, 1999 (EP) ..... 99811062

(51) Int. Cl.[7] ..... B65H 29/66
(52) U.S. Cl. ..... 271/216; 242/258
(58) Field of Search ..... 271/216; 242/258

(56) References Cited

U.S. PATENT DOCUMENTS 4,589,603 A 5/1986 Müller
4,896,870 A * 1/1990 Kobler ..... 270/60
5,029,843 A * 7/1991 Kobler ..... 271/204
5,116,043 A 5/1992 Jermann et al.
5,228,670 A * 7/1993 Kobler ..... 271/3.14
5,318,288 A * 6/1994 Byttebier et al. ..... 271/216

FOREIGN PATENT DOCUMENTS

EP 0 953 533 A1 11/1999
GB 2 134 493 A 8/1984
JP 05201599 A * 8/1993 ..... B65H/29/51
JP A 8-67382 3/1996

* cited by examiner

*Primary Examiner*—Donald P. Walsh
*Assistant Examiner*—Kaitlin Joerger
(74) *Attorney, Agent, or Firm*—Oliff & Berridge, PLC

(57) ABSTRACT

In a method for putting into storage and dispensing sheet-like objects, in particular bank notes, between at least one tension storage belt into or from a storage reel, in time periods between input and dispensing cycles, at least one belt tightening operation (F1–F3), which uses an increased belt tightening tension by comparison with the base belt tension is carried out. This operation is used to tighten up the belt in the belt spool of the storage reel so that the objects in the belt spool are tightened to increase the storage reel capacity and in order preferably to lend the belt spool greater mechanical stability so that the latter remains stable at the sides even when the filling level is high. Advantageously, the belt tightening is carried out in pulsed manner at a repetition frequency in the Hertz range using a pulse duty factor of active tensioning force relative to a base nominal value of between 0.2 and 2.0, preferably in the region of 1.0.

10 Claims, 2 Drawing Sheets

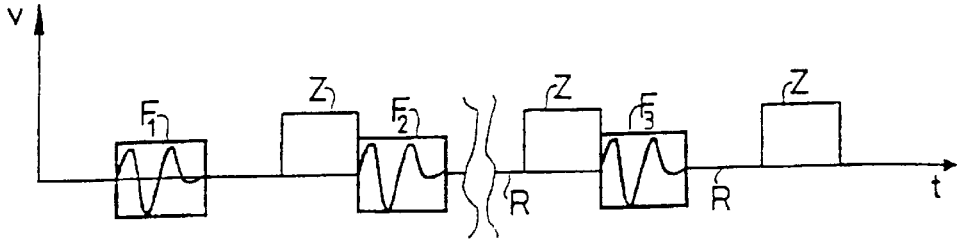
Fig. 3
Fig. 4
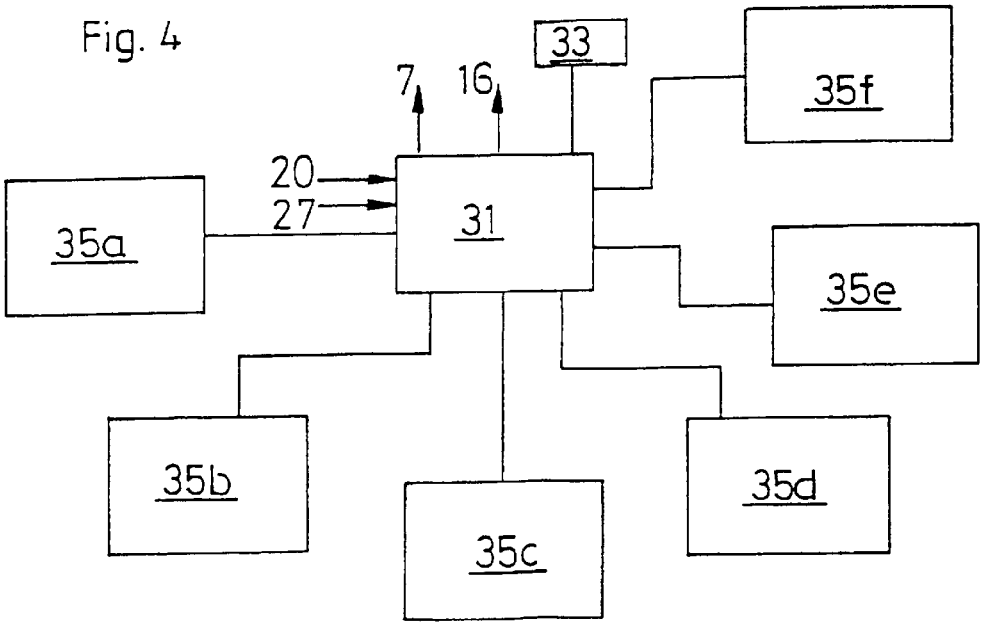

METHOD FOR PUTTING INTO STORAGE AND DISPENSING SHEET-LIKE OBJECTS, AND DEVICE FOR CARRYING OUT THIS METHOD

BACKGROUND OF THE INVENTION

1. Field of Invention

The invention relates to a method for putting into storage and dispensing sheet-like objects, in particular bank notes, between storage belts on a storage reel. The invention further relates to a device for carrying out this storage method.

2. Description of Related Art

The term sheet-like objects is preferably meant bank notes. However, by means of the method according to the invention and the device associated therewith other sheet-like objects, such as coupons, cheques, etc., by way of example, can also be stored away in a belt spool of a storage reel.

GB-A 2 143 493 discloses a device for storing and dispensing bank notes respectively in and from a storage reel. In the known device, the bank notes were wound up onto a storage reel clamped between two storage belts, that is to say an upper and a lower belt. One end of each of the two belts was fastened to the axle of the storage reel and the other belt ends were each fastened to an axle of two belt feed reels. In order that there was a certain tension in both belts during storage, the storage reel was driven and the two belt feed reels were braked. During dispensing, the two belt feed reels were then driven and the storage reel braked.

A further device according to the generic category is disclosed by EP-A 0 409 809. The two storage belts are held under tension. On storage, only one bank note was fed in and after each infeed, the storage belt was stopped. This operation ensued at a rate of ten bank notes per second. In order to maintain the belt tension when the belt is stationary, a reduced electric voltage was applied to the drives of both belt feed reels and the storage reel was secured against running backwards by means of a magnetically operated detent pawl. Dispensing was carried out at a constant translation rate.

A bank note storage device having a storage reel and a belt feed reel arrangement is also disclosed in EP-A 0 290 731. In order that the belt speed could be held constant regardless of the diameter of the belt spool clamping the bank notes on the storage reel, the reel axle was not driven in this case but rather the outer mantle of the belt spool in question. Tension in the belt was achieved by a higher number of revolutions in each case for the winding reel relative to the unwinding reel. Limitation of the belt tension was achieved by using friction contact.

A further bank note storage device having a storage reel and a belt feed reel arrangement is disclosed in EP-A 0 655 407. The known device was constructed in such a way that it made do with only one drive motor for both reel arrangements. Here too the belt tension was achieved by means of differing drive speeds.

SUMMARY OF THE INVENTION

It is the aim of the invention to store sheet-like objects on a storage reel at as high a packing density as possible and in positionally stable manner.

When sheet-like objects, preferably bank notes, were stored in the belt spool of a storage reel, the storage capacity was limited by a predetermined radius for the belt spool. If this radius were exceeded, it could happen that the outer part of the belt spool shifted axially relative to the inner part during a plurality of storage and dispensing operations as a result of which the belt spool threatened to fall apart either by itself or as a result of jolts or improper mounting. This risk of disintegration was heightened in storage of bank notes each checked in a predetermined position. That is to say, bank notes are not of uniform thickness over their surface area. Thus, such a belt spool could assume a conical mantle shape due to which the tendency to instability was further increased.

Due to repeated storage and dispensing of bank notes, it could further occur that the notes migrated from the small conical diameter to the larger as a result of which there was no longer neat and tidy storage. Accordingly, in order to keep this migratory movement within bounds and not to move into regions of instability of the belt spool typically only a maximum of approximately 240 bank notes were stored on the storage reels.

The invention provides a remedy here in that in periods of time between input and dispensing cycles in contrast with the aforementioned state of the art, at least one belt tightening operation is carried out using an increased belt tightening tension by comparison with the normal belt tension. That is to say, the state of the art recognized only one belt tension except for a tolerance which was achieved by braking or a higher speed of rotation of the running reel relative to the drive reel.

Thus, due to the application of an increased belt tightening tension by comparison with the continuous belt tension, further tightening of the storage belt ensues, which when repeated between input and dispensing cycles yields a reduction in diameter with a very tight wound state. In the wind-up procedure here proposed according to the invention, an extremely tight and stable belt spool results which does not tend to fall apart and by comparison with the knowing wind-up procedure permits a distinctly higher capacity for stored bank notes as well as a greater belt spool diameter.

Preferably, tightening is done not just once but rather several times between cycles. Good results have been achieved using a repetition frequency in the Hertz range of approximately 4 Hz and a pulse duty factor of tightening force to the normal base belt tensioning force of 0.2 to 2.0, preferably of 1.0. The tightening phases last as a rule just as long as the input and dispensing phases of some seconds (order of magnitude of 1 to 60 seconds).

Further advantages of the invention emerge from the following text.

BRIEF DESCRIPTION OF THE DRAWINGS

Examples of the method according to the invention and of the device according to the invention are described in more detail below with reference to the figures. These show:

FIG. 3 an illustration of the time-dependence of the belt speed of a storage belt in the device illustrated in FIG. 1 during the operation of tightening a belt loop on the storage reel; and FIG. 4 a block diagram of the computation modules working in conjunction with a control unit of the device illustrated in FIG. 1.

DETAILED DESCRIPTION OF PREFERRED EMBODIMENTS

Figure 1:
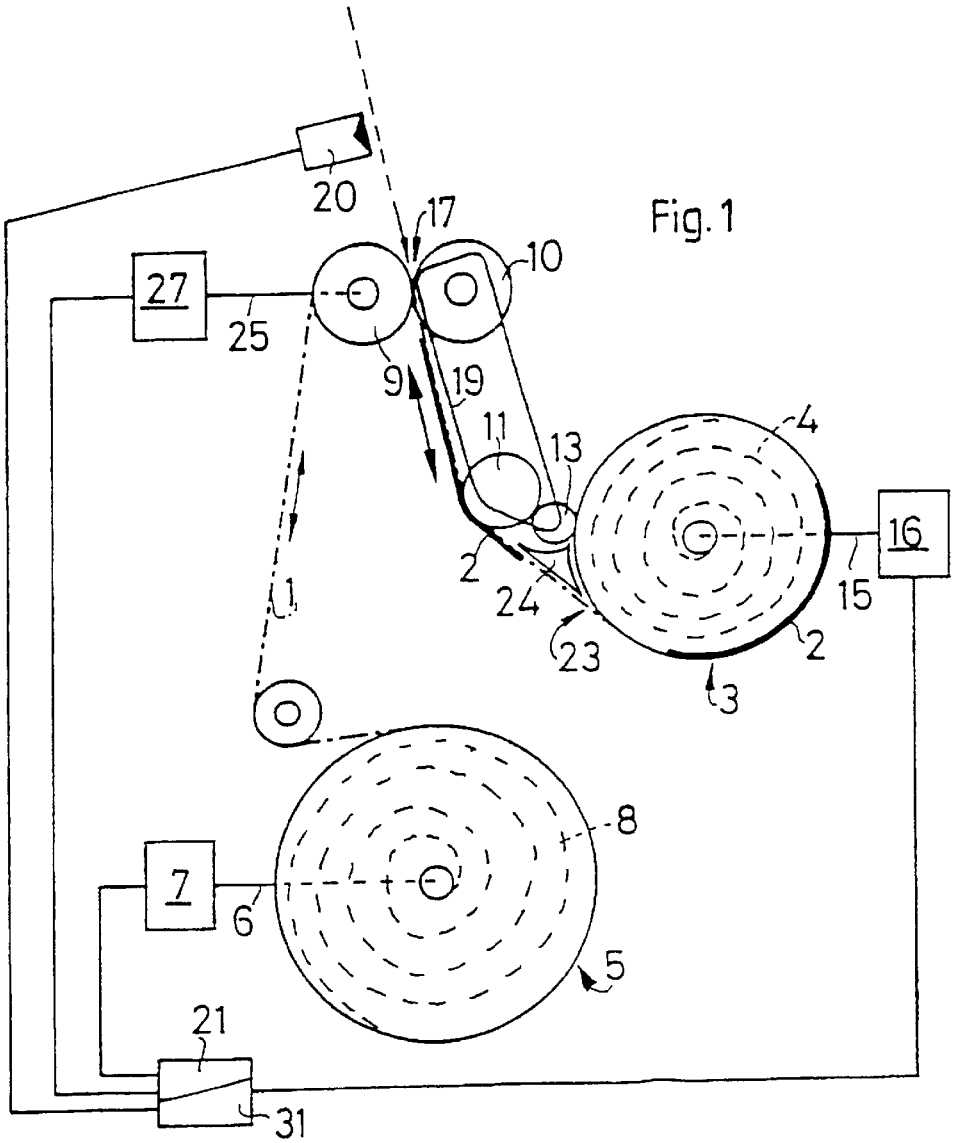
FIG. 1 a schematic illustration of a device according to the invention for putting into store and dispensing sheet-like objects.

The procedure according to the invention for reeling on and reeling off a belt-like or ribbon-like material, what is referred to as a storage belt 1 in this case, with sandwiching of sheet-like objects, (e.g., bank notes 2) is described with reference to the device according to the invention illustrated in FIG. 1. In FIG. 1 the thickness relationships of the bank notes 2 to be stored in the belt spool 4 on a storage reel 3 and those of the storage belt 1 are illustrated in highly exaggerated manner.

FIG. 1 shows a schematic side elevation of the device. One end of a single storage belt 1 in one piece in the direction of transport T is fastened to a storage reel 3 and the other end to a belt feed reel 5. The storage belt 1 is windable and unwindable on the latter from a belt spool 8 of the belt feed reel 5. In FIG. 1 only the belt spools 4 and 8 of the storage reel 2 and the belt feed reel 5 are illustrated in simplified manner. The belt feed reel 5 is rotatable about its axle 6. A stepping motor 7 acts on the axle 6. From the belt feed reel 5, the storage belt 1 runs via a guide roller 9, opposite which a pressure roller 10 is arranged. From the guide roller 9 the path of the storage belt 1 leads through a tension roller 11 to the belt spool 4 of the storage reel 2. A roller 13 is pressed onto the mantle of the belt spool 4, and is thus driven via the storage reel 3. The storage reel 3 is rotatable about a fixed axle 15 which can be driven as well as braked by a further stepping motor 16. The storage belt 1 is wound up on the storage reel 3 in the layers of the belt spool 4, and the end of the belt is fastened in the vicinity of the axle 15. The stored bank notes 2 are clamped between the wound layers of the storage belt. Breadthwise, that is perpendicular to the transport direction T, a plurality of belts can be present, preferably running parallel to one another. The diameter of the belt spool 4 changes during storing and dispensing of the bank notes 2 as a consequence of the winding and unwinding of the storage belt 1 with the notes 2 located therebetween. For purposes of putting into storage, the objects 2 are brought up one after the other to an input or output slot 17, usually by means of a conveyor belt (not shown). The slot 17 is formed by the storage belt 1 running over the guide roller 9 and the mantle of the pressure roller 10. After entry into the slot 17, the bank notes 2 lying on the storage belt 1 are transported and protected against lifting off by a guide plate 19, which is mechanically connected to the rollers 10, 11 and 13. The tension roller 11 presses the bank notes 2 once more against the storage belt 1. The distance between the pressure roller 10 and the tension roller 11 is smaller than the smallest width of the bank notes 2 to be stored. The distance of the tension roller 11 from the mantle of the belt spool 4 is also smaller than this width.

The putting of the bank notes 2 into storage is preferably monitored by sensors 20 for the optimum utilization of storage space on the storage reel 3. Ahead of the infeed/output slot 17, an optical sensor 20 can now be arranged which monitors the spacing of the incoming bank notes 2 relative to one another and controls the infeed operation accordingly. The optical sensor 20 together with the two stepping motors 7 and 16, as drives for the belt feed reel 5 and the storage reel 3, are linked in terms of signaling to a control device 21. Depending on the distance between the bank notes 2, the drives 7 and 16 are then switched via the control device 21 to on, off or braking.

Due to a bending effect, the bank notes adhere well to the material of the belt spool 4 since they are bent during an almost complete revolution. This adhesion effect is further reinforced by a certain static charge in the case of a storage belt 1 made of electrically insulating material and likewise electrically non-conducting bank notes. In the case of highly soiled and/or "limp" bank notes 2, however, this adhesion may be markedly reduced. Although extremely improbable, in order to prevent the bank notes 2 lifting off in the inlet or outlet region 23 by a guide member 24 of godet-like cross-section, which is only indicated in the illustration, may be arranged there.

For purposes of determining the belt speed v as described below, the axle 25 is connected to the guide roller 9 by a belt speed measuring sensor 27. Since the diameter of the guide roller 9 is known, the belt speed v can be determined at any time.

In the case of the drives, the stepping motors 7 and 16 can be supplied with appropriate power pulses in conventional manner by the control device depending on the desired number of revolutions per minute.

For purposes of braking one or both exciting windings of the steeping motor 7 or 16 in question can be closed. However, the exciting windings can be acted on under control by a predetermined resistance as described in European patent application EP 99 810 303.0. This action is effected in this case with a clock frequency of 16 kHz by way of example. The braking behavior of the stepping motor is only marginally dependent on the chosen clock frequency (100 Hz to 100 kHz and higher) but dependent on the chosen pulse duty factor.

For purposes of deepening understanding of the invention, the interplay of the two motors 7 and 16 in addition to the tightening according to the invention during storage and dispensing of the bank notes 2 also is described.

The two motors 7 and 16 are jointly responsible for the translation movement of the storage belt 1. The storage belt 1 must never loosen. There must always be a minimum belt tension as otherwise on start-up or a mechanical tension jolt would occur when the belt 1 is pulled tight: Acceleration and braking are executed in "soft" manner in such a way that no sudden changes in speed occur. The following states of motion result for the storage reel 3 and the belt feed reel 5:

reel in or reel out creep in or creep out tightening constant translation speed.

Reeling in and reeling out are referred to when the reels are accelerated or braked to the maximum extent. In creep in and creep out slow positioning tasks are accomplished. In tightening, the two motors 7 and 16 turn in opposite directions in order to tension the storage belt 1 with the maximum available force. This operation is carried out several times in succession. Since stepping motors are used, no tearing of the storage belt 1 is to be expected; before this happens one of the two motors cuts out.

In all sequences of movements, it further has to be taken into account that during storage and dispensing, the diameter of the belt spool in question of the storage and belt feed reel 3 and 5 respectively changes. It is set out below, by way of example, how the belt speed v and also the acceleration of the belt are held at a predetermined value independently of the belt spool diameter.

Stepping motors have a limited working range. The torque is limited at a high numbers of revolutions. That is to say, at high belt speeds, the acceleration is limited. Accordingly, the appropriate start-up curve is imprinted on the corresponding motor 7 or 16 by the control device 21.

Figure 2:
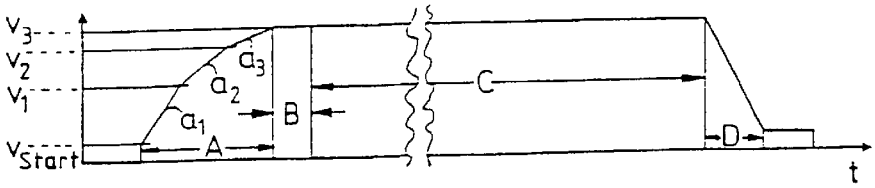
FIG. 2 an illustration of the time-dependence of the belt speed of a storage belt in the device illustrated in FIG. 1.

The operating state of reeling in and reeling out serves the purpose of moving the storage belt 1 over relatively large paths. In the example explained here, final speeds of 800 mm/s are achieved. Reeling in is used to put the bank notes into storage in the belt spool 4 of the storage reel 3. The movement sequence associated with this is illustrated in FIG. 2. In the diagram shown in FIG. 2, the belt speed v belt is plotted on the ordinate and the time t on the abscissa. By way of example, the acceleration phase A is divided here in accordance with the type of stepping motor 16 and used into three linear segments a1, a2 and a3. For the acceleration phase A, the stepping motor 16 is operated in what is referred to as boost mode. In the acceleration phase A, the stepping motor 7 is without excitation. A certain storage belt tension is achieved only by the mass acceleration of the belt feed reel 5, its belt spool 8, its stepping motor 7 and the moving parts associated with these. At the end of the acceleration phase A, the motor 16 remains in time period B in boost mode for approximately a further half second in order to avoid overloading of the transient effects. For the constant translation movement (time period C), which now follows a speed regulation system described below for driving the stepping motor 16 is switched on. The stepping motor 7 is switched to braking according to the method described in EP 99 810 303.0 mentioned above. At regular time intervals, the speed measurements described below of the of the storage belt 1 are made for purposes of regulating the speed. If braking is to be done (time period D), a final measurement of speed is carried out.

"Full braking" is now carried out by the stepping motor 7. The stepping motor 16 is run at low level. The braking ramp is linear in order to keep the braking path as short as possible. Any "falling out of step" of the stepping motor 7 is to be ignored. After braking, a brief pulling phase E follows so that there is no loss of tension. Reeling out is used for dispensing bank notes 2 from the belt spool 4 of the storage reel 3. By analogy with the movement sequence described above, the stepping motor 7 is now driven and the stepping motor 16 braked. In order to maintain belt tension after braking, a brief pulling phase now ensues, in which in contrast with the pulling phase E the motor 16 is driven and the motor 7 continues in "full braking" mode.

Even during creeping in the start-up curve likewise consists of three linear acceleration segments analogous to those in FIG. 2. The final speed to be achieved is, however, lower. Since creeping in occurs only over a short length of storage belt, no account need be taken of the change in the belt spool during creeping in.

Creeping in and creeping out is done by way of example when positioning the last bank note 2 in taking the run-up prior to dispensing and in the tightening operation described below.

In order to store the bank notes 2 as sheet-like objects on the storage reel 3 in positionally stable manner and at the highest possible packing density according to the invention in the time periods between storing and/or dispensing cycles, at least one belt tightening operation with an increased belt tightening tension by comparison with the normal base belt tension is carried out as indicated in FIG. 3. Three tightening operations F1, F2 and F3 are plotted in FIG. 3.

Tightening is done in each case when the storage belt 1 is in a state of rest, (i.e., not in the state of reeling in or reeling out, creeping in or creeping out and also not in the state of a constant translation speed). During tightening, both stepping motors 7 and 16 are simultaneously operated in opposite directions. In doing so the belt speed and its direction are undefined. The storage belt 1 is pulled at both ends. The more powerful motor pulls the less powerful one. A tightening phase is followed by a rest phase R and immediately after this a pulling phase Z is carried out in order to prevent any loosening of the storage belt in the belt spool. Subsequently, tightening may be carried out again. Repeated brief tightening yields a better result than one long tightening operation. Belt tightening is done in pulsed manner with a repetition frequency in the Hertz range and with a pulse duty factor of acting tensioning force relative to a nominal value of between 0.2 and 2.0, preferably in the region of 1.0.

As already indicated above, the changing diameter of the belt spool on the storage reel 3 and the belt feed reel 5 in consequence of feeding in and dispensing bank notes 2 is taken into account. In order to have the same storage belt speed v at all times, the control device 21 must determine the corresponding belt spool diameter of the reel 7 or 16 driven by a stepping motor. In this case, the ratio of the angular velocity creel of the driven reel in question to the storage belt speed v belt is determined. As already set out above, the storage belt speed v belt is calculated by the control device 21 via measured values from the belt speed measuring sensor 27. The angular velocity of the driven reel (3 or 5) is known by addressing the corresponding stepping motor (7 or 16). The radius r spool of the belt spool 4 or 8 on the driven reel is then $$r_{spool}-V_{belt}/\omega_{reel}.$$

The driving stepping motor rotates at a predetermined angular velocity $\omega_{reel,\ test}$. At the same time, the angular velocity of the guide roller 9 is measured and the storage belt speed $V_{belt,\ actual}$, and from this, the current spool radius $r_{spool}$ is determined, from which the required storage belt speed $V_{belt,\ desired}$ is then adjusted with a new angular velocity $\omega_{reel,\ adjust}$ via the drive of the corresponding drive motor. Measurement is always done on the drive roller. The determination must be made continuously since the spool radii change continuously. That is to say, only the winding speed of the stepping motor just being driven is always known, while that of the other is unknown.

Thus, the spool radius of the reel being pulled cannot be measured via a stepping motor drive since there is no active drive (however by flange-mounting an angular velocity gauge it could be measured by analogy with the pulling reel). It is, however, needed for the braking moment to be applied, but an approximate estimate suffices for this purpose.

The control device 21 is used to control the movement sequences in storing and dispensing the bank notes 2 and, by way of example in this case, to control a so-called automatic teller machine whose other functions will not be gone into here. Some of the control modules of the control device are shown in FIG. 3. To control the two stepping motors 7 and 16, the control device 21 has a drive module 31 which in the drive phase transmits the corresponding power pulses to the stepping motors, and for braking in accordance with a description set down in EP 99 810 303.0 applies a predetermined resistance to the exciting winding of the stepping motor in question to be braked in pulsed manner (clock frequency of 100 Hz to 100 kHz and higher), and in passive manner with an adjustable pulse duty factor. Preferably, a clock frequency of 16 kHz is used and the pulse duty factor is adjusted according to the desired braking behavior via the angular velocity.

Apart from the two stepping motors 7 and 16, the drive module is additionally connected to the belt speed measuring sensor 27, the optical sensor 20 and an input and command unit 33 of the automatic teller machine. Other connections run to six computation modules 35*a* to 35*f*. The computation module 35*a* controls the base movements and the movement sequence between the two stepping motors 7 and 16, such as the starting and stopping times matched to one another for driving and braking. The computation module 35*b* generates the acceleration and braking gradients for the regulation of speed. As explained above, the computation module 35*c* calculates the spool diameter at the time on the storage reel 3 or on the belt feed reel 5. The computation module 35*d* controls the braking operation and monitors the tightening operation. The computation module 35*e* monitors the active phase of the stepping motors 7 and 16 and in the event of a motor stoppage, switches the latter off after a predetermined length of time with an error message for example. The computation module 35*f* carries out graduated monitoring of speed.

In the exemplified embodiment described above, the storage reel 3 and the belt feed reel 5 are moved via the stepping motors 7 and 16. However, a movement making use of the belt tightening operation may also be carried out with other drives (direct current, alternating current, pneumatic drives).

In the examples set out above a belt spool accommodating bank notes is drawn together by applying a "pulsed" belt tightening tension. However, belt spools without bank notes or without insertion of sheet-like objects can also be pulled together using the method described above.

What is claimed is:

1. A method for putting into storage and dispensing sheet-like objects between at least one tension storage belt into or from a storage reel, the method comprising:

carrying out at least one belt tightening operation using an increased belt tightening tension which is compared with a base belt tension in time periods between input spensing cycles, wherein the tightening operation tightens up the belt in the belt spool of the storage reel so that the objects in the belt spool are tightened to increase the storage reel capacity and in order to lend the belt spool greater mechanical stability so that the storage reel remains stable at the sides even when the filling level is high.

2. The method according to claim 1, wherein the sheet-like objects are bank notes.

3. The method according to claim 1, wherein a belt end of each storage belt is held on a belt feed reel and the other end on the storage reel, the belt feed and the storage reels are each driven by a drive and applies a force component in opposite directions to each belt for tightening the belt of the drives.

4. The method according to claim 1, wherein the belt tightening is carried out in pulsed manner at a repetition frequency in the Hertz range using a pulse duty factor of acting tensioning force relative to a base nominal value of between 0.2 and 2.0, preferably in the region of 1.

5. The method according to claim 1, wherein the belt feed and storage reel are each driven by a stepping motor, a plurality of tightening operations are carried out successively and each tightening operation is terminated as soon as one of the motors (7, 16) cuts out, wherein preferably each motor is switched off after a predetermined length of time during tightening in order to prevent overheating thereof.

6. The method according to claim 1, wherein the storage reel is rotated at a predetermined first angular velocity ($\omega_{reel,test}$) and at the same time the belt speed (v) is measured, from which the current radius ($r_{spool}$) of the belt spool on the storage reel and from the latter a second angular velocity (reel, adjust) is then determined in such a way that the belt speed (v) is constant except for a tolerance in the storage operation, wherein for dispensing the procedure is analogous in relation to the drive of the belt feed reels.

7. The method according to claim 1, further comprising an adjustable braking moment during winding for putting an object into storage and during unwinding for dispensing an object, wherein each drive is switched to driving and the other to braking, and the braking moment is a nominal braking moment which is reduced in such a way that the belt tensioning force is constant regardless of the instantaneous belt spool diameter.

8. A device for carrying out the method according claim 1 for putting into storage and dispensing sheet-like objects, in particular bank notes between at least one storage belt coming from a belt feed reel on a storage reel, characterised by a drive for the belt feed and the storage reel and a control device acting on each drive by means of which each drive is separately controllable so that braking behavoir can be carried out in controlled manner, or in the case of the drive controlled in the opposite direction, the sheet-like objects on the storage reel can be tightened in the storage reel belt spool between the belt layers by means of a belt tightening tension in order to increase the storage reel capacity and the mechanical stability of the belt spool.

9. The device according to claim 8, wherein each of the drive is a stepping motor.

10. The device according to claim 8, further comprising a speed measuring device connected to the control device for determining the speed of the belt between the belt feed and storage reels, wherein the control device correspondingly controls the stepping motors for driving or braking the belt feed and the storage reels as a function of the belt speed values determined.

* * * * *